US005950591A

United States Patent [19]

Kageyama et al.

[11] Patent Number: 5,950,591

[45] Date of Patent: Sep. 14, 1999

[54] ENGINE OIL DETERIORATION PREVENTING AGENT AND DEVICE

[75] Inventors: Yuji Kageyama; Akihiro Takahashi; Yukio Kinugasa, all of Susono, Japan

[73] Assignee: Toyota Jidosha Kabushiki Kaisha, Aichi, Japan

[21] Appl. No.: 09/104,237

[22] Filed: Jun. 25, 1998

[30] Foreign Application Priority Data

Jul. 3, 1997 [JP] Japan ..... 9-178458
Nov. 21, 1997 [JP] Japan ..... 9-321274

[51] Int. Cl.[6] ..... F01M 9/02

[52] U.S. Cl. ..... 123/196 S; 123/196 R; 123/196 A; 184/6.21; 184/6.6; 184/2.21

[58] Field of Search ..... 184/6.21, 6.6, 184/2.21; 123/196 R, 196 A, 196 S

[56] References Cited

U.S. PATENT DOCUMENTS 2,389,555 11/1945 Sharples ..... 184/6.21
3,356,182 12/1967 Robinson et al. ..... 184/6.21
5,327,861 7/1994 Rogalla et al. ..... 184/6.21

FOREIGN PATENT DOCUMENTS 60-190964 U 12/1985 Japan .
61-6663 U 1/1986 Japan .
61-49053 U 4/1986 Japan .
61-74614 U 5/1986 Japan .
62-195612 U 12/1987 Japan .
64-39411 U 3/1989 Japan .
A-3-290012 12/1991 Japan .

*Primary Examiner*—Tony M. Argenbright
*Assistant Examiner*—Mahmoud M. Gimie
*Attorney, Agent, or Firm*—Oliff & Berridge, PLC

[57] ABSTRACT

According to the present invention, there is provided an engine oil deterioration preventing agent comprising, an addition agent for preventing a deterioration of an engine oil, and a housing body for housing the addition agent therein to discharge the addition agent to the engine oil when the engine oil is deteriorated.

23 Claims, 12 Drawing Sheets

NORMAL TEMPERATURE

HIGH TEMPERATURE

Fig.2a
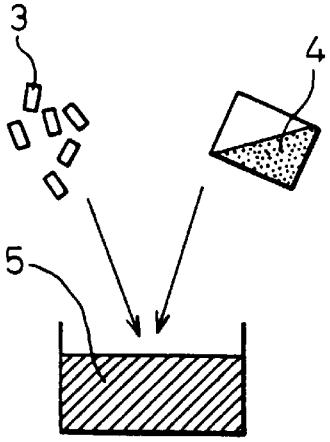
Fig.2b
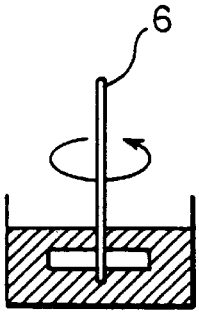
Fig.2d
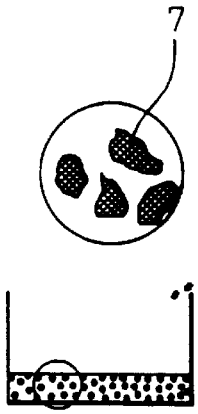
Fig.2c
Fig.3
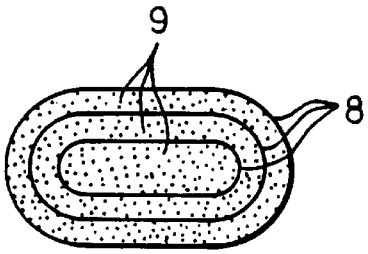

ENGINE OIL DETERIORATION PREVENTING AGENT AND DEVICE

BACKGROUND OF THE INVENTION

1. Field of the Invention

The invention relates to an agent and a device for preventing deterioration of an engine oil. In particular, the invention relates to an agent and a device for preventing deterioration of an engine oil by adding the agent to the engine oil when an amount of the agent already included in the engine oil is decreased.

2. Description of the Related Art

An engine oil functions to lubricate movable parts of an engine to decrease the friction therebetween and prevent the wear thereof. The engine oil is exposed to a severe environment. Further, the engine oil is deteriorated due to material coming from a combustion chamber of the engine. The material includes acid material such as a sulfuric acid or a hydrochloric acid generated from a combustion gas, unburned fuel, a sludge component and carbon. In order to prevent the deterioration of the engine oil, some agents for preventing the deterioration of the engine oil (hereinafter referred to as "addition agent") are mixed in the base oil.

The basic addition agent normally used includes a metal cleaner, an oxidation inhibitor, an ash-free dispersing agent, a wear preventing agent, an ash-free rust preventing agent, a viscosity index improver, a pour point depressant, an antifoaming agent, a corrosion preventing agent, and a friction adjusting agent.

The engine oil is deteriorated due to the deterioration of the engine oil itself. The deterioration of the engine oil itself is due to oxidation of the base oil and the addition agents, generation of an organic oxide by a heat decomposition, and consumption of the addition agents.

Further, the engine oil is deteriorated due to dirt in the engine oil. The dirt in the engine oil is due to a mixture of metal abrasion powders, combustion products or dust included in the air into the engine oil.

In order to prevent the dirt remaining in the engine oil, as disclosed in Japanese Unexamined Patent Publication 3-290012, an oil filter comprising a filter element in the form of a paper is provided in a lubrication system to filter the engine oil to eliminate foreign matter from the engine oil. The filtering efficiency is increased and the lifetime of the above oil filter is extended.

Using the above oil filter, the dirt in the engine oil can be removed. However, the above oil filter cannot prevent the deterioration of the engine oil itself due to a decrease in the amount of the addition agents included in the engine oil. Further, the above oil filter may trap the addition agents included in the engine oil. As a result, the amount of the addition agents which can flow in the lubrication system is decreased.

Therefore, the object of the invention is to add addition agents to the engine oil according to the decrease in the addition agents already included in the engine oil to prevent the deterioration of the engine oil.

SUMMARY OF THE INVENTION

According to the invention, there is provided an engine oil deterioration preventing agent comprising: addition agent for preventing deterioration of an engine oil; and a housing body for housing the addition agent therein to discharge the addition agent into the engine oil when the engine oil is deteriorated.

Further, according to the invention, the housing body is formed with polymeric filaments which are entangled.

Further, according to the invention, the housing body comprises a capsule which houses the addition agent therein.

Further, according to the invention, the housing body comprises capsules which are concentrically arranged, and each of capsules houses the addition agent therein.

Further, according to the invention, the housing body comprises a honeycomb structure having holes, and each hole houses the addition agent therein.

Further, according to the invention, an amount of an addition agent in the engine oil is decreased when the engine oil is deteriorated, and the housing body discharges the addition agent to the engine when the amount of the addition agent in the engine oil is decreased.

Further, according to the invention, a viscosity of the engine oil is decreased when the engine oil is deteriorated, and the housing body discharges the addition agent to the engine when the viscosity of the engine oil is decreased.

Further, according to the invention, a pressure of the engine oil is decreased when the engine oil is deteriorated, and the housing body discharges the addition agent to the engine when the pressure of the engine oil is decreased.

Further, according to the invention, a temperature of the engine oil is increased when the engine oil is deteriorated, and the housing body discharges the addition agent to the engine oil when the temperature of the engine oil is increased.

According to the invention, there is provided an engine oil deterioration preventing device comprising: addition agent for preventing deterioration of an engine oil; a housing body for housing the addition agent therein to discharge the addition agent to the engine oil when the engine oil is deteriorated; and supporting means for supporting the housing body in the engine oil passage.

Further, according to the invention, the housing body discharges the addition agent into the engine oil due to the flow of the engine oil.

Further, according to the invention, the supporting means puts the housing body in contact with a part of an engine, and the housing body discharges the addition agent to the engine oil by contact with the part of the engine.

Further, according to the invention, the part of the engine has a movable part, the supporting means puts the housing body into sliding contact with the movable part, and the housing body discharges the addition agent to the engine oil by the sliding contact with the movable part.

Further, according to the invention, the supporting means has a spring for putting the housing body into sliding contact with the movable part, and the housing body discharges the addition agent to the engine oil by the sliding contact with the movable part.

Further, according to the invention, the part of the engine has a stationary part which is in sliding contact with the movable part, and the supporting means puts the housing body into sliding contact with the movable part according to an amount of wear of the stationary part.

Further, according to the invention, the supporting means has a member which is removable from the engine oil passage, and the supporting means puts the housing body in contact with a portion of the engine when the member is positioned in the engine oil passage.

According to the invention, there is provided an engine oil deterioration preventing device comprising: addition agent for preventing deterioration of an engine oil; a plurality of housing bodies for housing the addition agent therein to discharge the addition agent into the engine oil when the engine oil is under at least one predetermined condition of several different conditions which represents the deterioration of the engine oil; and supporting means for supporting a plurality of the housing body in the engine oil.

Further, according to the invention, the housing bodies are arranged in line along the flow of the engine oil.

Further, according to the invention, each housing body has a wall which forms an interior for housing the addition agent, and the walls have different thicknesses, respectively.

The present invention may be more fully understood from the description of the preferred embodiments of the invention set forth below, together with the accompanying drawings.

BRIEF DESCRIPTION OF THE DRAWINGS

In the drawings:

FIG. 2*a* is a view showing a first step of making the engine oil deterioration preventing agent according to the first embodiment;

FIG. 2*b* is a view showing a second step of making the engine oil deterioration preventing agent according to the first embodiment;

FIG. 2*c* is a view showing a third step of making the engine oil deterioration preventing agent according to the first embodiment;

FIG. 2*d* is an enlarged view of the circled region of FIG. 2*c;*

FIG. 3 is a view showing an engine oil deterioration preventing agent according to the second embodiment of the invention;

DESCRIPTION OF THE PREFERRED EMBODIMENTS

An engine oil deterioration preventing agent according to the first embodiment will be explained below.

The engine oil deterioration preventing material or agent comprises a housing body constituted by a chain of polymeric materials or filaments 1 (hereinafter referred to as "polymeric chain"). These polymeric materials 1 are entangled to form spaces therebetween. Addition agent 2 for preventing the deterioration of an engine oil as described below in detail is housed in these spaces. The engine oil functions to keep movable parts lubricated.

The polymeric material 1 comprises, for example, a thermoplastic resin or a thermosetting resin such as a polycarbonate, a polyamide resin or an epoxy resin which can withstand a severe environment where the engine oil is used. The addition agent 2 comprises commonly used agents, for example, a metal cleaner such as a sulfonate, a phenate or a phosphate which are organometallic compounds of barium, calcium or magnesium, an oxidation inhibitor such as a zinc dithiophosphate, a phenol derivative or an organic amine, a corrosion preventing agent such as an organic sulphide, an organic phosphate or alkylthiophosphate, a pour point depressant such as a paraffin wax-naphthalene condensate or a methacrylic polymer, a viscosity index improver such as a polymer of an olefin, an isoolefin or butylene, or a wear preventing agent such as a higher fatty acid, a higher alcohol, an ester or a ketone.

Figure 1A:
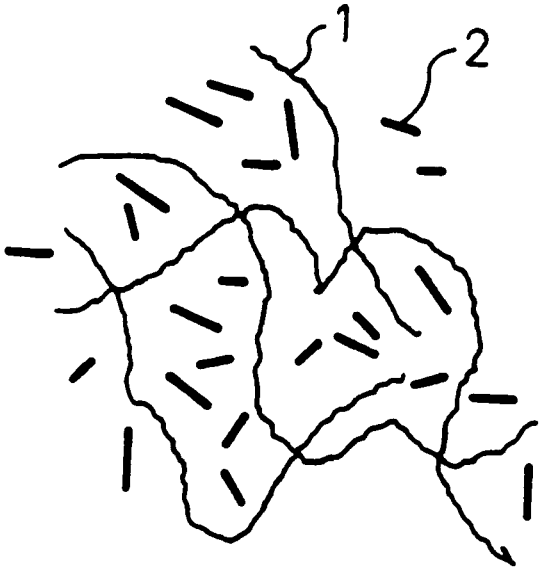
FIG. 1*a* is a view showing an engine oil deterioration preventing agent at a normal temperature around the agent according to the first embodiment of the invention.
Figure 1B:
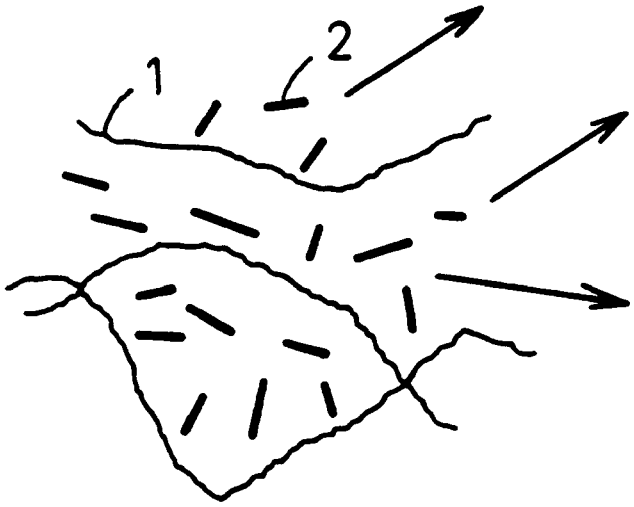
FIG. 1*b* is a view showing the engine oil deterioration preventing agent at a high temperature around the agent according to the first embodiment.

As shown in FIG. 1*a*, the polymeric chain 1 is kept entangled when the temperature around the polymeric chain 1 is normal. Therefore, the polymeric chain 1 can house the addition agent 2 therein. On the other hand, as shown in FIG. 1*b*, the polymeric chain 1 is released when the temperature around the polymeric chain 1 is high since an amount of a movement of the polymeric materials is increased due to the high temperature. Therefore, the addition agent 2 is discharged from the high polymer chain 1.

Further, the addition agent 2 already added to the engine oil is consumed during the use of the engine oil. Therefore, the difference in the concentration between the addition agent in the engine oil and the addition agent in the polymeric chain 1 is occurred. As a result of this concentration difference, the addition agent 2 is also discharged from the polymeric chain 1. In other words, the addition agent 2 is discharged from the polymeric chain 1 to the engine oil when the amount of the addition agent already included in the engine oil is decreased.

Moreover, a hydrogen ion exponent (pH) in the engine oil is decreased when an oxidation preventing agent as the addition agent 2 in the engine oil is consumed by the thermal decomposition. Therefore, alternatively, the addition agent 2 may be discharged from the polymeric chain 1 according to the change of the pH in the engine oil.

A method for making an engine oil deterioration preventing agent according to the first embodiment will be explained.

In FIG. 2*a*, reference number 3 shows polymeric material such as pellets of polycarbonate for making the polymeric chain 1, number 4 shows component of the addition agent 2, and number 5 shows good solvent such as a methylene chloride for the polymeric material.

Firstly, as shown in FIG. 2*a*, the polymeric material 3 and the component 4 of the addition agent 2 are simultaneously added to the solvent 5. Secondly, as shown in FIG. 2*b*, the solvent 5, the polymeric material 3 and the component 4 of the addition agent 2 are agitated by an agitator 6. Finally, as shown in FIG. 2*c*, the solvent 5 is vapourized to obtain an engine oil deterioration preventing agent 7 shown in a greater detail in FIG. 2*d*. As described above, the engine oil deterioration preventing agent 7 comprises an entangled polymeric chain 1 and the addition agent 2 housed in the spaces formed in the polymeric chain 1.

Alternatively, the housing body may be formed in the form of a capsule for housing the addition agent 2 therein. For example, the capsule is formed of material such as a silicon gum which has a semi-permeability. Since the capsule has a semi-permeability, the addition agent 2 is discharged from the capsule according to the amount of the decrease in the concentration of the addition agent already added to the engine oil. Thus, the concentration of the addition agent in the engine oil is kept generally constant.

Further, the discharging characteristic of the addition agent 2 from the capsule is controlled by controlling the material and thickness of the capsule. The discharging characteristic of the addition agent 2 includes, for example, a velocity of the discharging of the addition agent 2 or a kind of the addition agent 2 discharged from the capsule.

Alternatively, the capsule may be formed of a material which is dissolved according to the pH in the engine oil. In this case, the addition agent 2 can be discharged from the capsule according to the change of the pH in the engine oil or the temperature around the capsule.

Further, the capsules having different thicknesses may be formed to sequentially break according to the change of the pH in the engine oil or the temperature around the capsules to gradually discharge the addition agent 2 to the engine oil. Therefore, the concentration of the addition agent in the engine oil is kept constant.

An engine oil deterioration preventing agent according to the second embodiment will be explained.

As shown in FIG. 3, the capsule is formed in the form of a multi-layer, and comprises three capsules 8 which are concentrically arranged. In this case, the capsules 8 is sequentially broken from the outermost layer to gradually discharge the addition agent to the engine oil. Therefore, the concentration of the addition agent in the engine oil is kept constant.

An engine oil deterioration preventing agent according to the third embodiment will be explained.

Figure 4A:
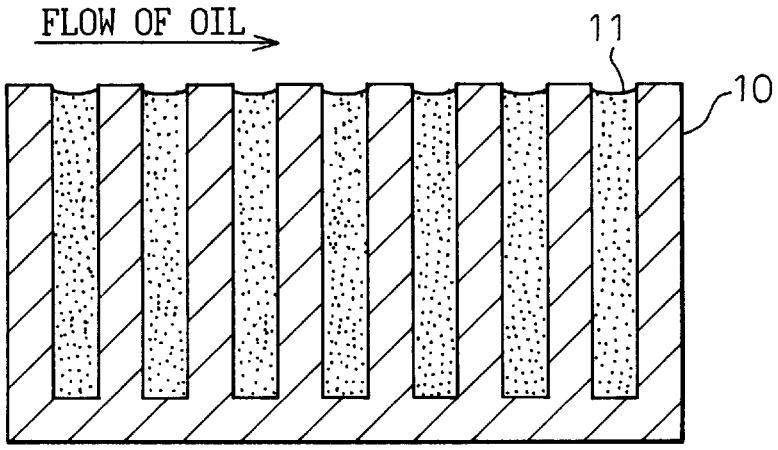
FIG. 4*a* is a sectional view showing an engine oil deterioration preventing agent according to the third embodiment of the invention.
Figure 4B:
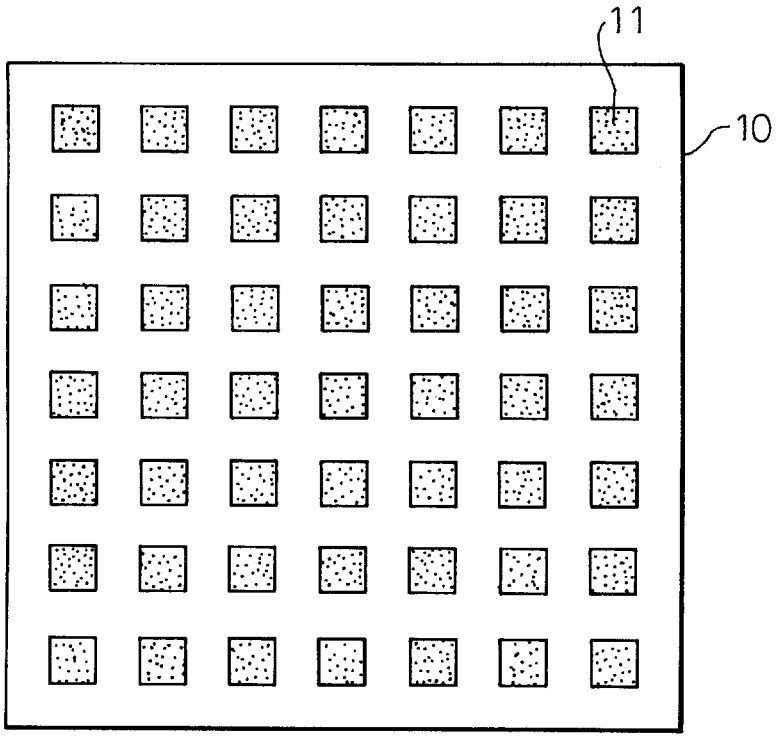
FIG. 4*b* is a plan view showing the engine oil deterioration preventing agent according to the third embodiment.

As shown in FIGS. 4*a* and 4*b*, the housing body according to the third embodiment is formed in the form of a honeycomb structure 10. The honeycomb structure 10 has elongated holes 11 therein. Each elongated hole 11 houses the addition agent 11. As shown in FIG. 4*a*, the engine oil flows adjacent to openings of the elongated holes 11. Therefore, the addition agent 11 is gradually discharged to the engine oil. Thus, the concentration of the addition agent in the engine oil is kept constant.

Further, the discharging characteristic of the addition agent from the engine oil deterioration preventing agent is controlled by controlling the depth and the sectional size of the elongated hole. The honeycomb structure is, for example, formed of a metal, a plastic or a ceramic.

Alternatively, the housing body may be formed of porous material. In this case, the addition agent can be discharged through pores of the housing body.

An engine oil deterioration preventing device according to the fourth embodiment of the invention will be explained below.

Figure 5:
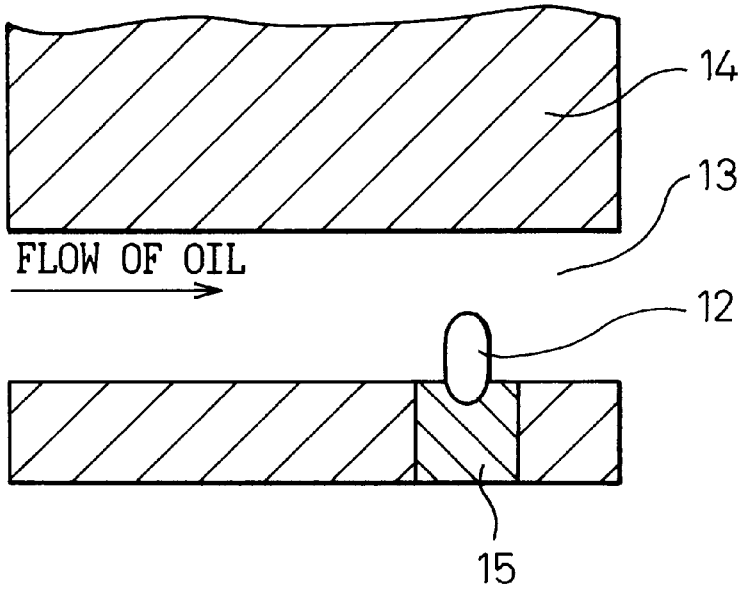
FIG. 5 is a view showing an engine oil deterioration preventing device according to the fourth embodiment of the invention.

The device employs a capsule type of engine oil deterioration preventing agent. As shown in FIG. 5, a capsule 12 which houses the addition agent is mounted on a plug 15. The plug 15 is inserted into a bore formed in a cylinder head or a cylinder block 14 with the capsule 12. The capsule 12 projects into an engine oil passage 13 located in the cylinder head 14. Therefore, the plug 15 corresponds to supporting means for supporting the capsule in the engine oil. According to the fourth embodiment, since the engine oil and/or soot included therein collide with the capsule 12 to wear the same, the capsule 12 is broken to discharge the addition agent to the engine oil therefrom.

To replace the used capsule 12 with new one, the plug 15 is firstly removed from the bore of the cylinder head 14. After the used capsule 12 is removed from the plug 15 and new one is mounted on the plug 15, the plug 15 is again inserted into the bore of the cylinder head 14. Therefore, according to the fourth embodiment, it is easy to replace the used capsule 12 with a new one.

Figure 6:
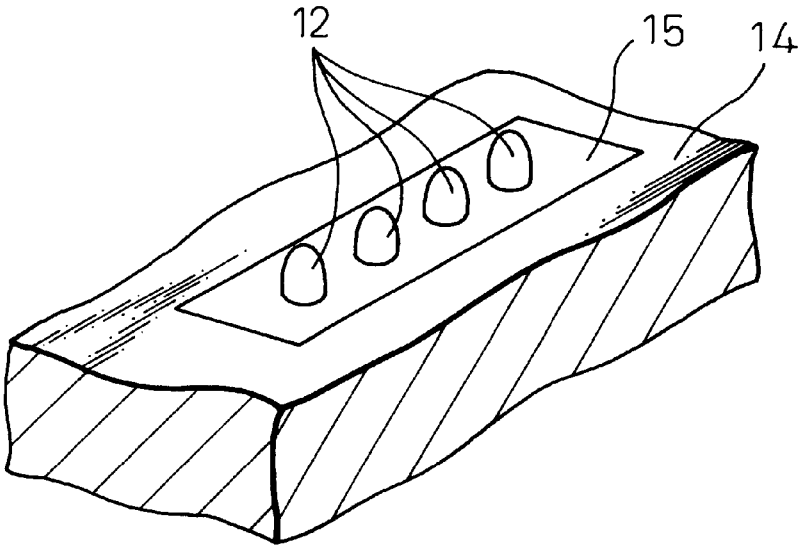
FIG. 6 is a perspective view showing an engine oil deterioration preventing device according to the fifth embodiment of the invention.

Alternatively, according to the fifth embodiment, as shown in FIG. 6, a plurality of the capsules 12 having the same thicknesses of walls thereof may be mounted on the plug 15 such that these capsules 12 are arranged in line from the upstream to the downstream of the engine oil passage 13, shown in FIG. 5 i.e., along the direction of the flow of the engine oil in the engine oil passage 13. In this case, since the capsule 12 that is located most upstream is initially broken, the addition agent in the capsules 12 is gradually added to the engine oil. Therefore, the concentration of the addition agent in the engine oil is kept constant.

Further, the discharging characteristics of the addition agent from the engine oil deterioration preventing device are controlled by controlling the thickness of the wall of the capsule.

An engine oil deterioration preventing device according to the sixth embodiment of the invention will be explained below.

Figure 7:
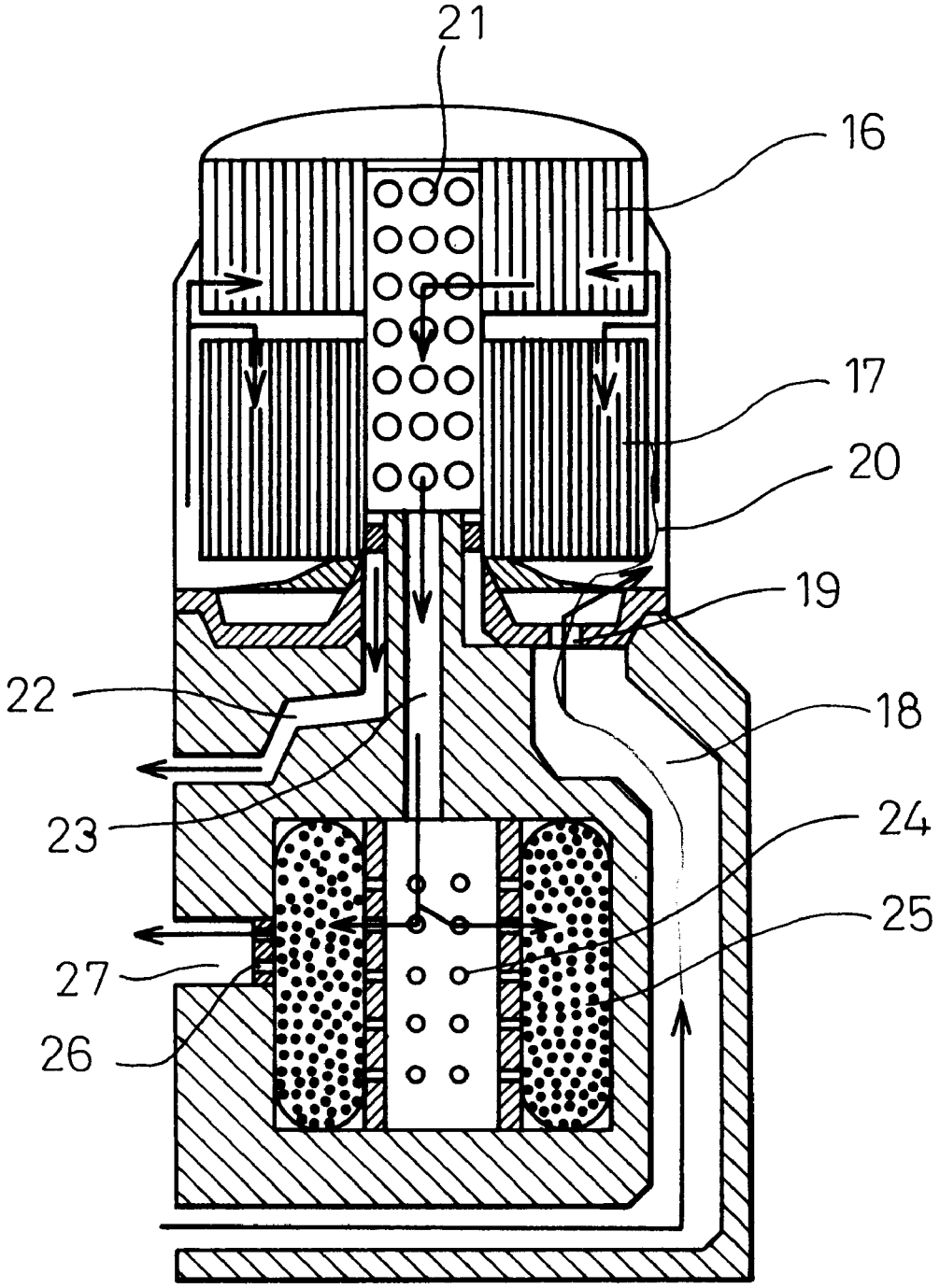
FIG. 7 is a view showing an engine oil deterioration preventing device according to the sixth embodiment of the invention.

The device employs a capsule type of engine oil deterioration preventing agent. As shown in FIG. 7, capsules 25 which house the addition agent are mounted in an oil filter system. In FIG. 7, reference number 16 shows a main filter, and number 17 shows a bypass filter. Some engine oil flows to the main and bypass filters 16 and 17 through a first engine oil passage 18, a first through hole 19 and a clearance 20. Foreign matter is trapped by the main and bypass filters 16 and 17. Some filtered engine oil is returned to an engine oil reservoir (not shown) through second through holes 21 and a second engine oil passage 22. The other filtered engine oil flows to the capsules 25 through a third engine oil passage 23 and third through holes 24. The addition agent in the capsules 25 is added to the engine oil when the engine oil passes through the capsules 25. The engine oil is discharged through slits 26 and a fourth engine oil passage 27. In sixth embodiment, the oil filter system corresponds to supporting means for supporting the capsules 25 in the engine oil.

An engine oil deterioration preventing device according to the seventh embodiment of the invention will be explained below.

Figure 8:
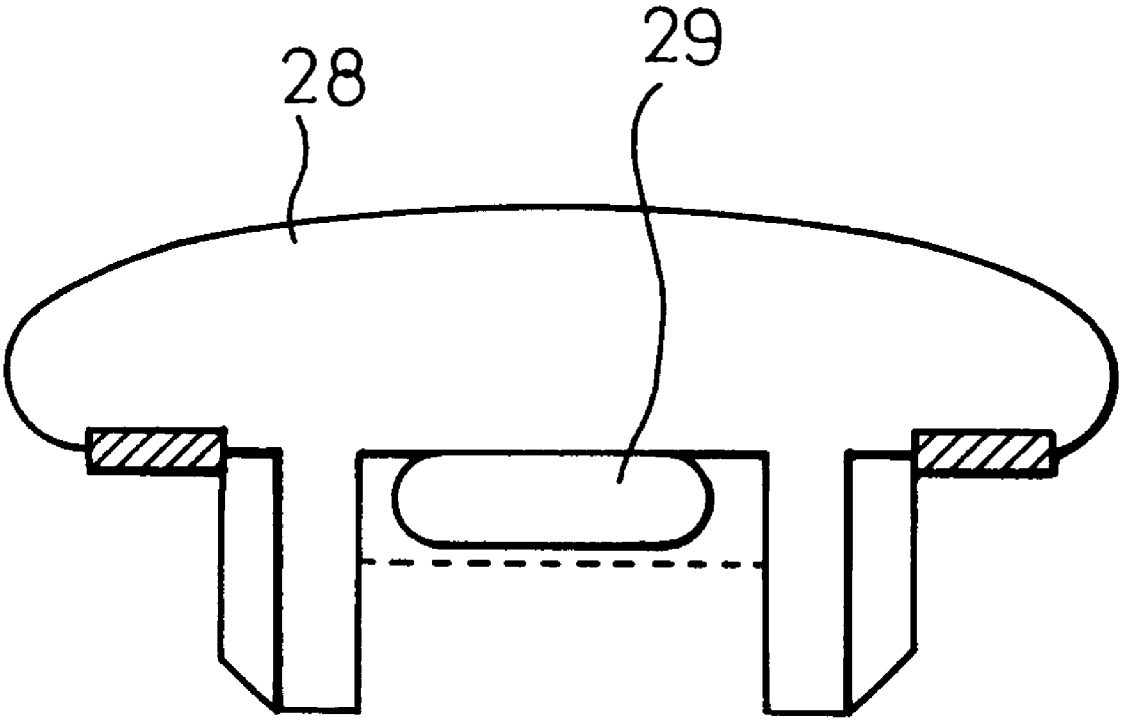
FIG. 8 is a view showing an engine oil deterioration preventing device according to the seventh embodiment of the invention.

The device employs a capsule type of engine oil deterioration preventing agent. As shown in FIG. 8, a capsule 29 which houses the addition agent is mounted on a back face of an oil filler cap 28. The filler cap 28 functions to close an opening of an engine oil tank (not shown) for introducing an engine oil into the engine oil tank.

According to the seventh embodiment, when the filler cap 28 is screwed into the opening of the engine oil tank, the capsule 29 is broken by the surroundings of the opening to discharge the addition agent from the capsule 29. Therefore, the filler cap 28 corresponds to supporting means for supporting the capsule 29 in the engine oil. Also, the filler cap 28 corresponds to a member which is removable from the engine oil passage. Since the engine oil should be regularly replaced with new one, the opportunity to replace the used capsule with the engine oil is regularly obtained. Therefore, according to the seventh embodiment, the work to replace the used capsule with new one is eliminated.

An engine oil deterioration preventing device according to the eighth embodiment of the invention will be explained below.

Figure 9:
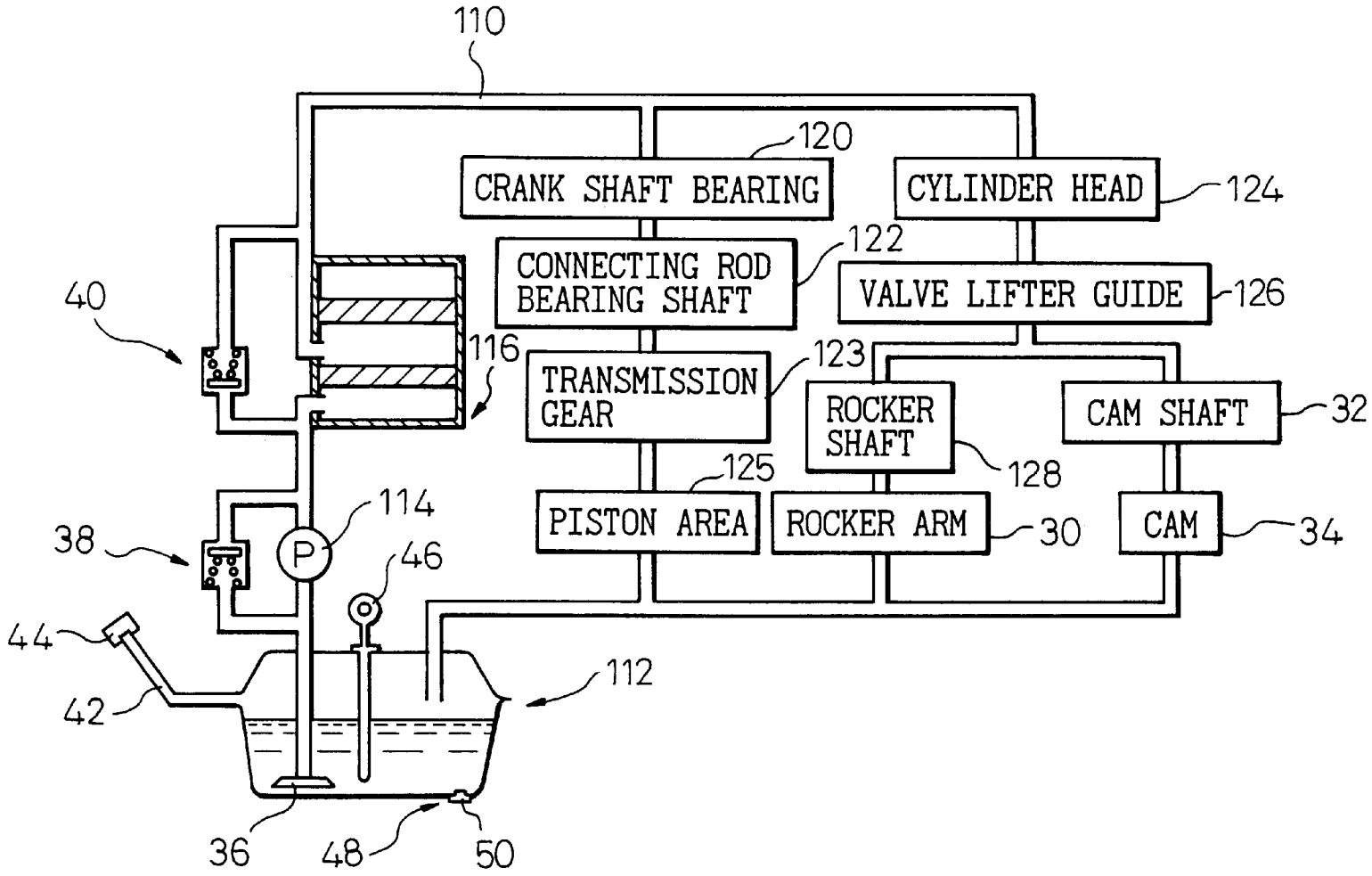
FIG. 9 is a view showing an engine system which employs an engine oil deterioration preventing device according to the eighth embodiment of the invention.

As shown in FIG. 9, an engine system which employs an engine oil deterioration preventing device according to the eighth embodiment comprises an engine oil circulation passage 110 (hereinafter referred to as "oil passage") for circulating the engine oil in the engine system. The oil passage 110 extends from an engine oil tank 112 to introduce the engine oil from the engine oil tank 112 to a first engine oil filter 116 via an engine oil pump 114 for pumping the engine oil from the engine oil tank 112.

Further, some engine oil in the oil passage 110 is returned from the first engine oil filter 116 to the engine oil tank 112 via a crank shaft bearing 120, a connecting rod bearing shaft 122, a transmission gear 123 and a piston area 125 in order. The crank shaft bearing 120 functions to hold a crank shaft 118 (see FIG. 10) for transmitting an output from the engine to vehicle wheels (not shown). The connecting rod bearing shaft 122 functions to hold a connecting rod for connecting the crank shaft 118 to a piston (not shown) of the engine. The transmission gear 123 functions to transmit an output from the crank shaft 118 to a cam shaft (not shown). The piston area 125 includes the piston, a piston ring mounted on the piston and a cylinder which houses the piston therein.

The rest of the engine oil discharged from the first engine oil filter 116 is introduced into a valve lifter guide 126 via the cylinder head 124. The valve lifter guide 126 functions to hold and guide intake and exhaust valves (not shown).

Some engine oil discharged from the valve lifter guide 126 is returned to the engine oil tank 112 via a rocker shaft 128 and a rocker arm 30 in order. The rocker arm 30 is rotatably connected to the rocker shaft 128. The rest of the engine oil discharged from the valve lifter guide 126 is returned to the engine oil tank 112 via a cam shaft 32 and a cam 34 in order. The cam 34 is connected to the cam shaft 32, and is rotated together with the cam shaft 32 according to an engine driving. The cam 34 is connected to the intake and exhaust valves via the rocker arm 30.

A second engine oil filter 36 for filtering the engine oil introduced into the oil passage 110 is mounted on an opening of the oil passage 110 in the engine oil tank 112.

Further, a first pressure regulation valve 38 is positioned in parallel to the engine oil pump 114. The first pressure regulation valve 38 returns the engine oil from the downstream of the engine oil pump 114 to the upstream of the engine oil pump 114 when a pressure of the engine oil downstream of the engine oil pump 114 is higher than a first predetermined engine oil pressure.

Further, a second pressure regulation valve 40 is positioned in parallel to the first engine oil filter 116. The second pressure regulation valve 40 bypasses the engine oil from the upstream of the engine oil filter 116 to the downstream of the engine oil filter 116 when a pressure of the engine oil upstream of the engine oil filter 116 is higher than a second predetermined engine oil pressure.

Note that the words "upstream" and "downstream" indicate the flow of the engine oil in the engine oil passage 10.

An engine oil filling pipe 42 for filling the engine oil tank 112 with an engine oil is connected to the engine oil tank 112. An upper opening of the engine oil filling pipe 42 is closed by a filler cap 44.

Further, a level gauge 46 is inserted into the engine oil tank 112 from the outside. The level gauge 46 functions to detect the level of the engine oil in the engine oil tank 112.

Further, a drainage outlet 48 is formed in a bottom wall of the engine oil tank 112. The drainage outlet is closed by a drainage plug 50. The engine oil is drained to the outside of the engine oil tank 112 via the drainage outlet 48.

An operation of the engine oil deterioration preventing device according to eighth embodiment will be explained below.

A degree of the deterioration of the engine oil is increased as a degree of the wearing of the bearing parts and the movable parts held thereby is increased. Therefore, in the eighth embodiment, the addition agent is added to the engine oil according to the degree of the wearing of the bearing parts and the movable parts held thereby.

Figure 10:
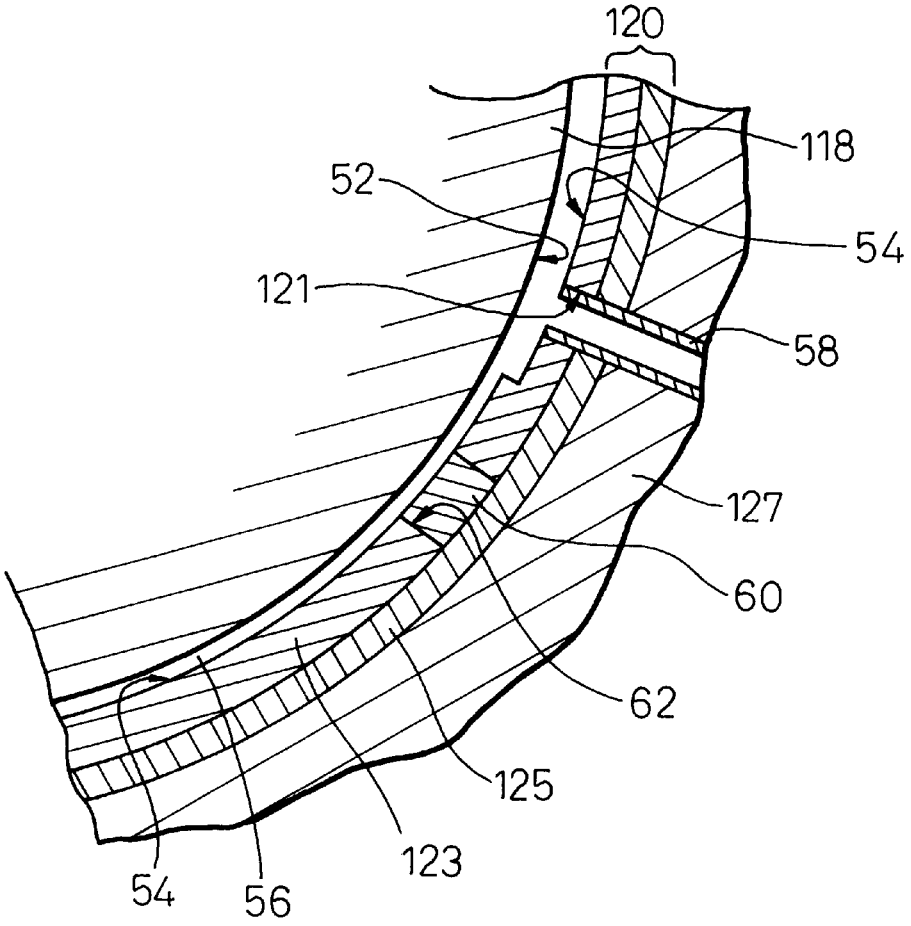
FIG. 10 is a sectional view showing a crank shaft bearing, and a crank shaft held thereby, which employs the engine oil deterioration preventing device according to the eighth embodiment.
Figure 11:
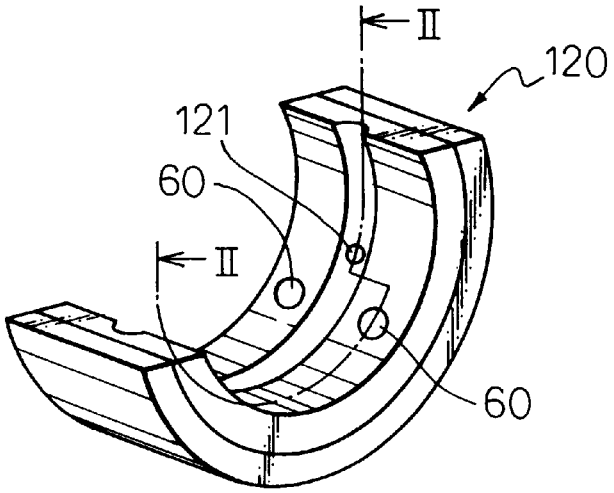
FIG. 11 is a perspective view showing the crank shaft bearing which employs the engine oil deterioration preventing device according to the eighth embodiment.

As shown in FIGS. 9 and 10, an engine oil passage 56 as a part of the oil passage 110 is formed between an outer face 52 of the crank shaft 118 and an inner face 54 of the crank shaft bearing 120. The engine oil passage 56 functions to receive the engine oil to lubricate the crank shaft 118. In the eighth embodiment, the crank shaft 118 corresponds to the movable part, and the crank shaft bearing 120 corresponds to the bearing part. Therefore, an oil film is formed between the outer face 52 of the crank shaft 118 and the inner face 54 of the crank shaft bearing 120.

An engine oil introduction hole 121 is formed in the crank shaft bearing 120. An engine oil introduction pipe 58 as a part of the oil passage 110 is inserted into the engine oil introduction hole 121. The engine oil introduction pipe 58 functions to introduce the engine oil into the engine oil passage 56. Further, the crank shaft bearing 120 is held by an engine body 127.

The crank shaft bearing 120 comprises an inner ring 123 formed of a white metal, and an outer ring 125 formed of a steel.

Figure 12:
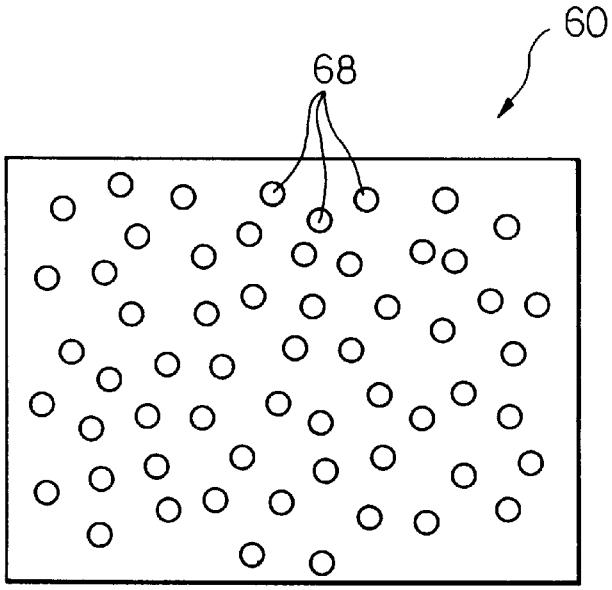
FIG. 12 is a view showing the engine oil deterioration preventing body used in the engine oil deterioration preventing device according to the eighth embodiment.

A housing hole 62 is formed in the inner ring 123. The housing hole 62 houses the engine oil deterioration preventing body 60. As shown in FIG. 12, the engine oil deterioration preventing body 60 is formed by solidifying a number of the capsules 68 with suitable material. The capsules 68 includes addition agents therein. Therefore, hereinafter, the engine oil deterioration preventing body 60 is just referred to as "agent body". The agent body 60 fills the housing hole 62. Further, a face of the agent body 60 which faces the outer face 52 of the crank shaft 118 is on a plane including the inner face 54 of the crank shaft bearing 120. Note that the agent body 60 cannot be dissolved by the engine oil in the engine oil passage 56.

Figure 13:
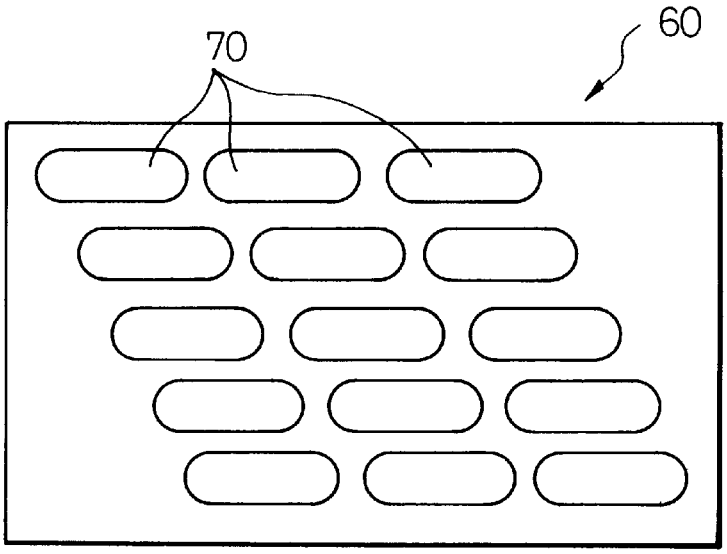
FIG. 13 is a view showing the engine oil deterioration preventing body according to the eighth embodiment of the invention.

If the capsule is large, the capsules may be not uniformly distributed in the agent body 60. In this case, as shown in FIG. 13, the capsules 70 should be solidified such that the capsules 70 are regularly positioned and uniformly distributed in the agent body 60.

Note that, in the eighth embodiment, the connecting rod, the valve lifter guide, the rocker arm, the cam, the piston, the piston ring and the transmission gear correspond to the movable part of the engine, and the connecting rod bearing shaft, a hole for the valve lifter guide, the cylinder and the transmitted gear correspond to the bearing part or a stationary part of the engine.

In the eighth embodiment, the inner face 54 of the crank shaft bearing 120 is worn since the crank shaft 118 rotates in the crank shaft bearing 120 while the outer face 52 of the crank shaft 118 comes into contact with the inner face 54 of the crank shaft bearing 120. At the same time, the outer face of the agent body 60 is also worn by the outer face 52 of the crank shaft 118 to discharge the addition agent to the engine oil. Therefore, the inner ring, i.e., the crank shaft bearing corresponds to supporting means for supporting the agent body 60.

According to the eighth embodiment, the addition agent housed in the capsules 68 in the agent body 60 is added to the engine oil in a simple manner. Further, the wear of the inner face 54 of the crank shaft bearing 120 corresponds to the degree of the deterioration of the engine oil. Therefore, since the addition agent is added to the engine oil according to the degree of the deterioration of the engine oil, the deterioration of the engine oil is suitably prevented.

Note that the area of the outer face of the agent body 60 which faces the crank shaft 118 is determined on the basis of the relation between the degree of the wear of the outer face 52 of the crank shaft 118 and the degree of the deterioration of the engine oil. That is, the larger the degree of the deterioration of the engine oil relative to a certain degree of the wear of the outer face 52 of the crank shaft 118 is, the larger the area of the outer face of the agent body 60 is.

Further, in the eighth embodiment, the inner face 54 of the crank shaft bearing 120 is worn while the agent body 60 is worn. Therefore, the crank shaft 118 should be replaced with new one at the same time as when the agent body should be replaced. Thus, according to the eighth embodiment, no additional work to replace the used agent body with new one is necessary.

An engine oil deterioration preventing device according to the ninth embodiment will be explained below.

Figure 14:
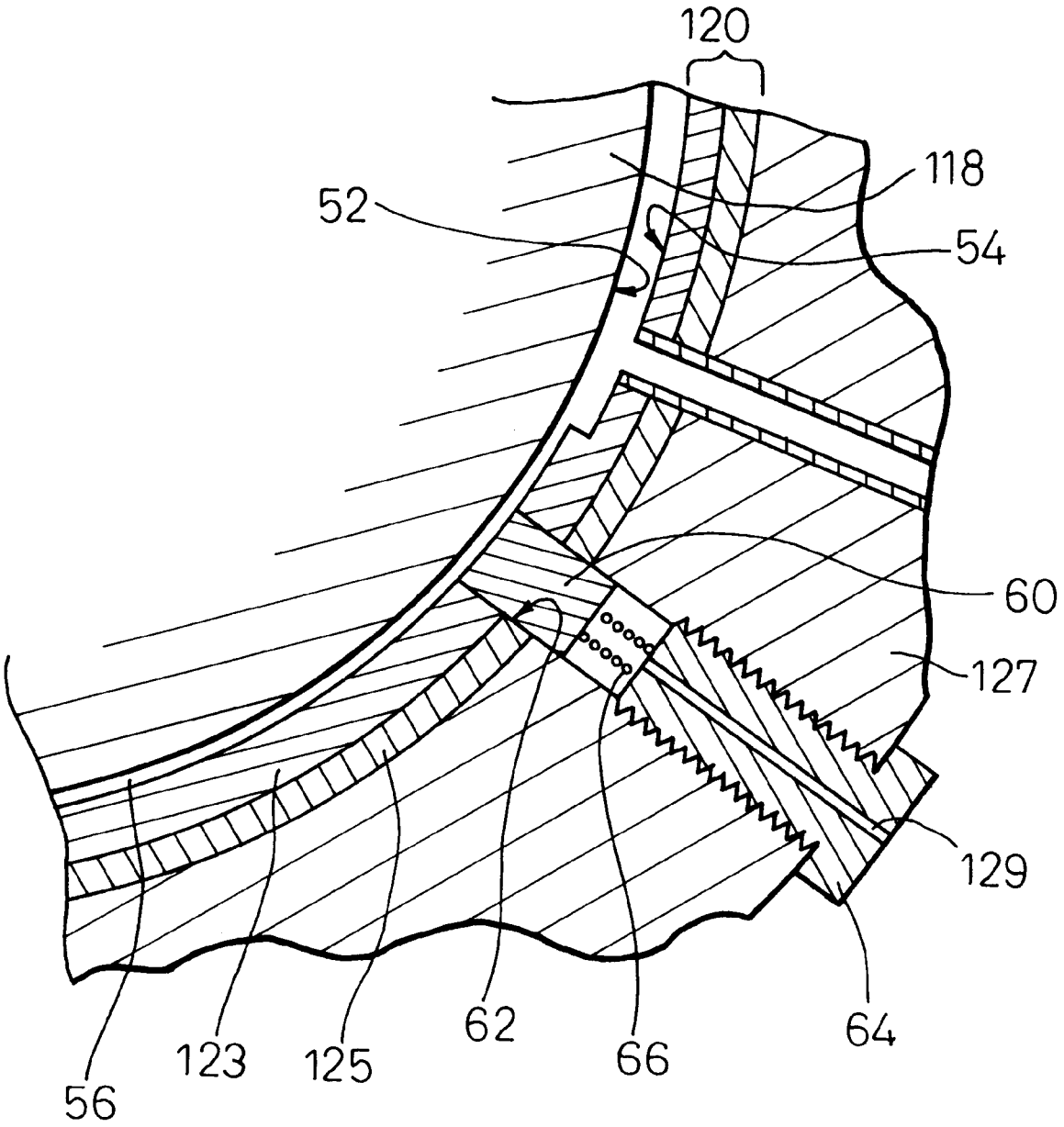
FIG. 14 is a sectional view showing a crank shaft bearing, and a crank shaft held thereby, which employs an engine oil deterioration preventing device according to the ninth embodiment.

As shown in FIG. 14, a housing hole 62 is formed such that the housing hole 62 passes through the inner ring 123, the outer ring 125 and the engine body 127. A plug bolt 64 is screwed into the housing hole 62 from the outside of the engine body 127 to close an opening of the housing hole 62. A communication passage 129 for communicating the interior of the housing hole 62 with the atmosphere is formed in the plug bolt 64.

A spring 66 as a biasing means is positioned between the agent body 60 and the plug bolt 64. When the spring 66 is compressed, the spring 66 forces the agent body 60 toward the crank shaft 118. The rate of the spring 66 is determined such that the maximum biasing force of the spring 66 is equal to the pressure of the non-deteriorated engine oil in the engine oil passage 56 when the engine driving is in the idling condition.

Components other than those described above are the same as those of the engine oil deterioration preventing device according to the eighth embodiment. Therefore, an explanation thereof will not be given.

The higher the engine speed is, the larger the pressure of the engine oil in the engine oil passage 56 (hereinafter referred to as "oil pressure") is. Therefore, the oil pressure is minimum when the engine driving is in the idling condition. Further, the larger the degree of the deterioration of the engine oil is, the lower the coefficient of the viscosity of the engine oil is, and the lower the oil pressure is. Further, the rate of the spring 66 is determined such that the biasing force of the spring 66 is equal to the pressure of the non-deteriorated engine oil when the engine driving is in the idling condition. Therefore, when the engine oil is not deteriorated, the agent body 60 remains in the housing hole 62 during all engine driving conditions since the biasing force of the spring 66 is always lower than the oil pressure.

On the other hand, when the engine oil is deteriorated, the coefficient of the viscosity of the engine oil is decreased, and the oil pressure is decreased. Therefore, when the oil pressure is decreased to the biasing force of the spring 66 due to the deterioration of the engine oil, the agent body 60 is forced toward the outer face 52 of the crank shaft 118 by the spring 66, and then comes into contact with the outer face 52. In other words, the spring makes the agent body 60 contact the outer face 52 of the crank shaft. The agent body 60 is worn by the frictional contact or sliding contact with the outer face 52 of the crank shaft 118. Therefore, the addition agent is added to the engine oil to increase the coefficient of the viscosity of the engine oil. Note that the inner ring, i.e., the crank shaft bearing and the spring 66 correspond to supporting means for supporting the agent body 60. Thus, the oil pressure is increased. When the oil pressure becomes equal to the biasing force of the spring 66, the agent body 60 is forced away from the outer face 52 of the crank shaft 118. Therefore, the addition of the addition agent is stopped.

In the ninth embodiment, the above addition operation of the addition agent is repeated according to the degree of the deterioration of the engine oil.

Further, in the ninth embodiment, when the engine driving is stopped, the oil pressure is lower than the biasing force of the spring 66. Therefore, when the engine driving is stopped, the agent body 60 comes into contact with the outer face 52 of the crank shaft 118. Thus, when the engine driving is started, the agent body 60 is worn by the outer face 52 of the crank shaft 118. According to the ninth embodiment, the addition agent is added to the engine oil at every start of the engine.

Further, it is preferred that the area of the outer face of the agent body 60 which faces the outer face 52 of the crank shaft 118 is large. In this case, the addition agent sufficient to restore the deterioration of the engine oil is added to the engine oil with a smaller extension of the spring 66. Thus, the agent body 60 has an extended lifetime so that the amount of work to replace the used agent body with new one is decreased.

Further, in the ninth embodiment, it is easy to replace the used agent body with new one by removing the plug bolt from the housing hole.

In the ninth embodiment, since the length of the agent body is decreased after a long use of the engine oil deterioration preventing device, the oil pressure at which the agent body comes into contact with the outer face of the crank shaft is increased. Therefore, after a long use of the engine oil deterioration preventing device, the degree of the deterioration of the engine oil exceeds an allowable value. Thus, the spring which has a rate of the spring larger than that of the spring 66 of the ninth embodiment may be used. In this case, the agent body comes into contact with the outer face 52 of the crank shaft 118 when the oil pressure becomes larger than a predetermined oil pressure smaller than the oil pressure at the idling driving condition. Therefore, degree of the deterioration of the engine oil does not become larger than the allowable value.

An engine oil deterioration preventing device according to the tenth embodiment is explained below.

The engine oil filter 116 should be regularly replaced with new one. Therefore, according to the tenth embodiment, the addition agent included in the agent body 60 is added to the engine oil when the engine oil filter 116 is replaced with new one.

Figure 15:
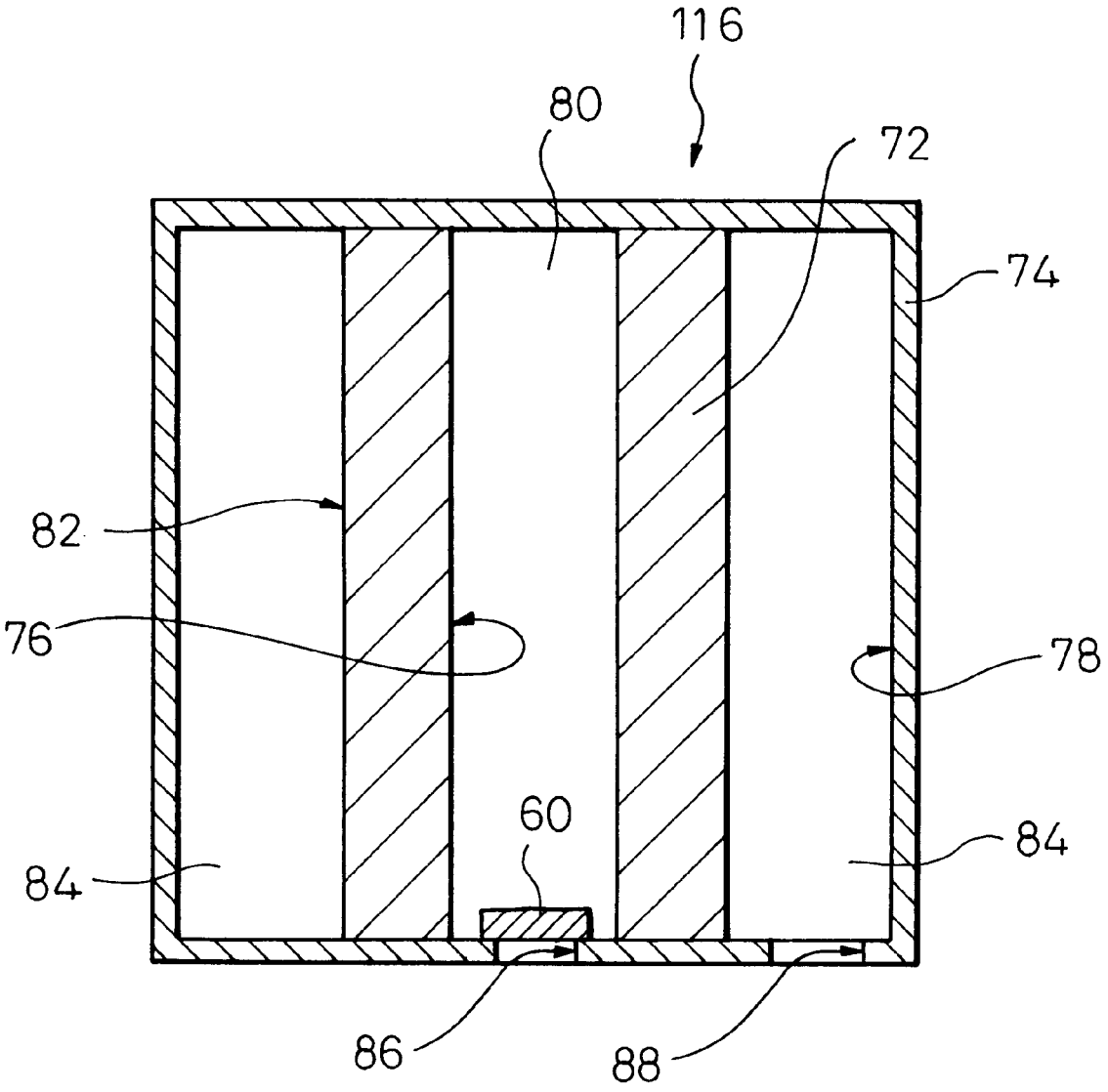
FIG. 15 is a sectional view showing an engine oil filter before the filter is mounted on an engine oil passage, which filter employs an engine oil deterioration preventing device according to the tenth embodiment.

As shown in FIG. 15, the engine oil filter 116 comprises an annular filter element 72 for filtering the engine oil to trap the foreign matters therein, and a housing 74 for housing the filter element 72.

A first engine oil receiving space 84 for receiving the non-filtered engine oil is formed between an outer face 82 of the filter element 72 and an inner face 78 of the housing 74. Therefore, the first engine oil receiving space 84 is formed outside of the filter element 72. Thus, hereinafter, the first engine oil receiving space 84 is just referred to as the "outside space". On the other hand, a second engine oil receiving space 80 for receiving the filtered engine oil is formed between an inner face 76 of the filter element 72 and the inner face 78 of the housing 74. Therefore, the second engine oil receiving space 84 is formed inside of the filter element 72. Thus, hereinafter, the second engine oil receiving space 84 is just referred to as the "inside space".

An opening 88 which is open to the outside space 84 is formed in the housing 74. The oil passage 110 is connected to the opening 88. Therefore, the engine oil is introduced into the outside space 84 via the opening 88. On the other hand, an opening 86 which is open to the inside space 80 is formed in the housing 74. The oil passage 110 is connected to the opening 88. Therefore, the engine oil is discharged from the inside space 80 via the opening 86.

Further, an agent body 60 is positioned in the inside space 80 such that the agent body 60 closes the opening 86. In the tenth embodiment, the agent body 60 can be easily broken to discharge the addition agent to the engine oil. Therefore, the engine oil filter 116 corresponds to supporting means for supporting the agent body. Also, the engine oil filter 116 corresponds to a member which is removable from the engine oil passage.

Components other than those described above are the same as those of the engine oil deterioration preventing device according to the eighth embodiment. Therefore, an explanation thereof will not be given.

Figure 16:
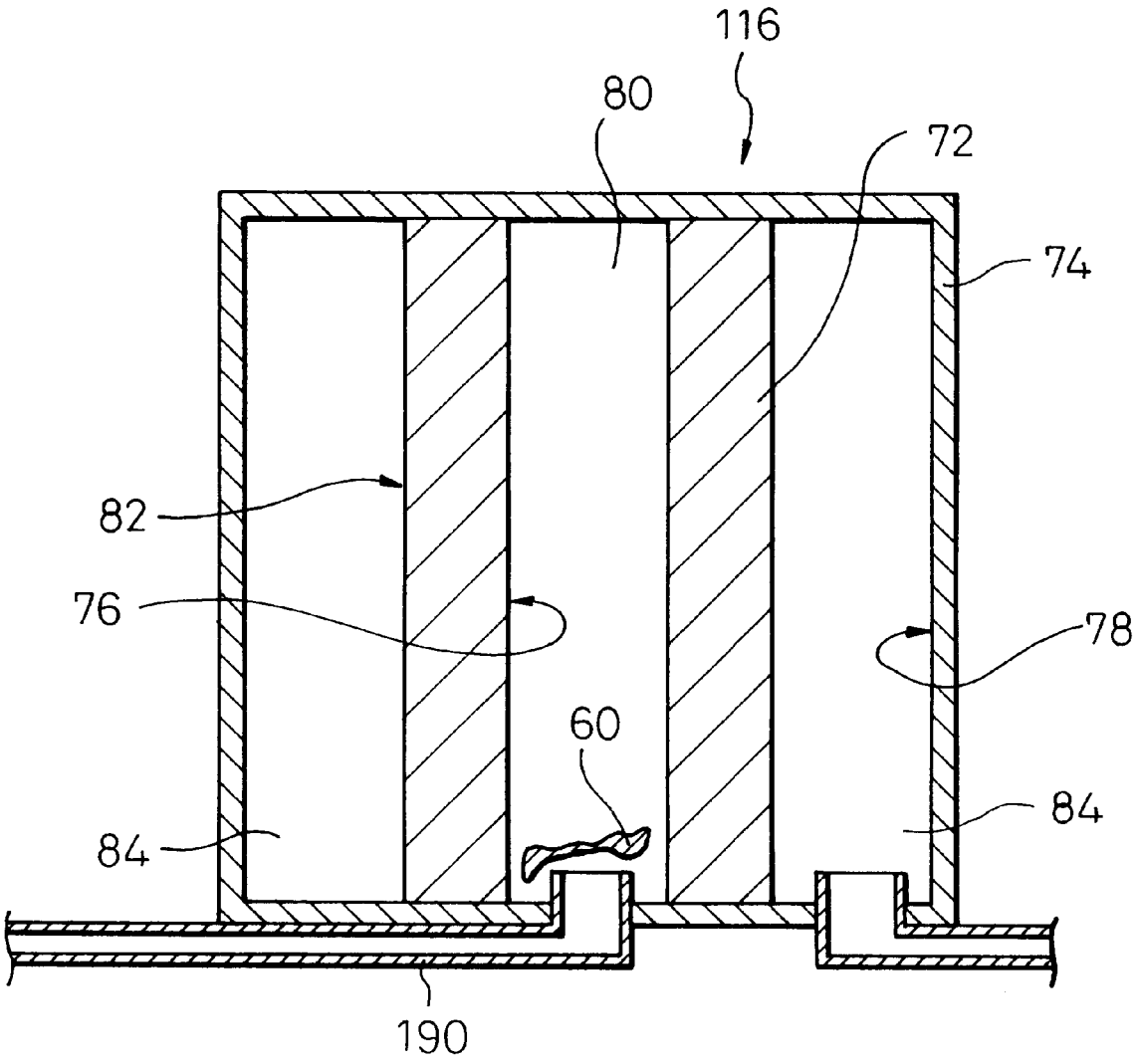
FIG. 16 is a sectional view showing the engine oil filter after the filter is mounted on the engine oil passage, which filter employs an engine oil deterioration preventing device according to the tenth embodiment.

According to the tenth embodiment, as shown in FIG. 16, when new engine oil filter 116 is positioned on the oil passage 110 to replace the used engine oil filter, a pipe which forms the oil passage 110 therein comes into contact with the agent body 60 to break the same. Therefore, the addition agent in the agent body 60 is added to the engine oil. As described above, since the engine oil filter 116 is regularly replaced with new one, the addition agent is regularly added to the engine oil.

Alternatively, the agent body 60 may be mounted on the level gauge 46 or the drainage plug 50 such that the agent body 60 is broken when the level gauge 46 or the drainage plug 50 is mounted on the engine oil tank 112.

While the invention has been described by reference to specific embodiments chosen for purposes of illustration, it should be apparent that numerous modifications can be made thereto by those skilled in the art without departing from the basic concept and scope of the invention.

We claim:

1. An engine oil deterioration preventing agent, comprising:

an addition agent for preventing a deterioration of an engine oil; and a housing body for housing said addition agent therein to discharge said addition agent to an operatively effective amount of said engine oil when said engine oil is deteriorated.

2. An engine oil deterioration preventing agent according to claim 1, wherein said housing body is formed with polymeric filaments which are entangled.

3. An engine oil deterioration preventing agent according to claim 1, wherein said housing body comprises a capsule which houses said addition agent therein.

4. An engine oil deterioration preventing agent according to claim 1, wherein said housing body comprises capsules which are concentrically arranged, and each capsule houses said addition agent therein.

5. An engine oil deterioration preventing agent according to claim 1, wherein said housing body comprises a honeycomb structure having holes, and each hole houses said addition agent therein.

6. An engine oil deterioration preventing agent according to claim 1, wherein when an amount of an addition agent in said engine oil is decreased when said engine oil is deteriorated, and said housing body discharges said addition agent to said engine oil when said amount of said addition agent in said engine oil is decreased.

7. An engine oil deterioration preventing agent according to claim 1, wherein a viscosity of said engine oil is decreased when said engine oil is deteriorated, and said housing body discharges said addition agent to said engine oil when said viscosity of said engine oil is decreased.

8. An engine oil deterioration preventing agent according to claim 1, wherein a pressure of said engine oil is decreased when said engine oil is deteriorated, and said housing body discharges said addition agent to said engine oil when said pressure of said engine oil is decreased.

9. An engine oil deterioration preventing agent according to claim 1, wherein a temperature of said engine oil is increased when said engine oil is deteriorated, and said housing body discharges said addition agent to said engine oil when said temperature of said engine oil is increased.

10. The engine oil deterioration preventing agent of claim 1, wherein said engine oil is disposed in an engine oil passage.

11. The engine oil deterioration preventing agent of claim 1, wherein said engine oil substantially fills an engine oil passage.

12. An engine oil deterioration preventing agent, comprising:

an addition agent for preventing a deterioration of an engine oil;

a housing body for housing said addition agent therein to discharge said addition agent to an operatively effective amount of said engine oil disposed in an engine oil passage when said engine oil in said engine oil passage is deteriorated; and supporting means for supporting said housing body in said engine oil passage.

13. An engine oil deterioration preventing device according to claim 12, wherein said housing body discharges said addition agent to said engine oil due to said flow of said engine oil.

14. An engine oil deterioration preventing device according to claim 12, wherein said supporting means puts said housing body in contact with a part of an engine, and said housing body discharges said addition agent to said engine oil due to said contact with said part of said engine.

15. An engine oil deterioration preventing device according to claim 14, wherein said part of said engine has a movable part, said supporting means puts said housing body in sliding contact with said movable part, and said housing body discharges said addition agent to said engine oil due to said sliding contact with said movable part.

16. An engine oil deterioration preventing device according to claim 15, wherein said supporting means has a spring for putting said housing body in sliding contact with said movable part, and said housing body discharges said addition agent to said engine oil due to said sliding contact with said movable part.

17. An engine oil deterioration preventing device according to claim 15, wherein said part of said engine has a stationary part which is in sliding contact with said movable part, and said supporting means puts said housing body in sliding contact with said movable part according to an amount of wear of said stationary part.

18. An engine oil deterioration preventing device according to claim 14, wherein said supporting means has a member which is removable from said engine oil passage, and said supporting means puts said housing body in contact with a portion of said engine when said member is positioned in said engine oil passage.

19. An engine oil deterioration preventing device comprising:

addition agent for preventing a deterioration of an engine oil;

a plurality of housing bodies for housing said addition agent therein to discharge said addition agent to said engine oil when said engine oil is under at least one predetermined condition out of different conditions which represents the deterioration of said engine oil; and supporting means for supporting a plurality of said housing body in said engine oil.

20. An engine oil deterioration preventing device according to claim 19, wherein said housing bodies are arranged in line along flow of said engine oil.

21. An engine oil deterioration preventing device according to claim 19, wherein each housing body has a wall which forms an interior for housing said addition agent, and said walls have different thicknesses, respectively.

22. An engine oil deterioration preventing agent, comprising:

a wall defining a space sized to contain an operatively effective amount of an engine oil;

an addition agent that prevents deterioration of the engine oil;

a housing body that houses said addition agent therein; and a member that is selectively attachable to the wall;

wherein the addition agent is released from the housing body and discharged into the space by attachment of the member to the wall.

23. The engine oil deterioration preventing agent of claim 22, wherein the wall comprises an engine oil tank.

* * * * *